US009799955B2

(12) United States Patent
Koster

(10) Patent No.: US 9,799,955 B2
(45) Date of Patent: Oct. 24, 2017

(54) TWO-DIMENSIONAL ELECTRONICALLY STEERABLE ANTENNA

(71) Applicant: Honeywell International Inc., Morristown, NJ (US)

(72) Inventor: Michael Koster, Johns Creek, GA (US)

(73) Assignee: Honeywell International Inc., Morris Plains, NJ (US)

( * ) Notice: Subject to any disclaimer, the term of this patent is extended or adjusted under 35 U.S.C. 154(b) by 317 days.

(21) Appl. No.: 14/733,350

(22) Filed: Jun. 8, 2015

(65) Prior Publication Data

US 2016/0359229 A1 Dec. 8, 2016

(51) Int. Cl.

| | |
|---|---|
| ***H01Q 3/00*** | (2006.01) |
| ***H01Q 3/36*** | (2006.01) |
| ***H01P 1/195*** | (2006.01) |
| ***H01P 1/165*** | (2006.01) |
| ***H01P 1/18*** | (2006.01) |
| ***H01P 1/19*** | (2006.01) |

(Continued)

(52) U.S. Cl.

CPC ..... *H01Q 3/36* (2013.01); *H01P 1/165* (2013.01); *H01P 1/182* (2013.01); *H01P 1/19* (2013.01); *H01P 1/195* (2013.01); *H01Q 3/34* (2013.01); *H01Q 3/44* (2013.01); *H01P 5/12* (2013.01); *H01Q 15/246* (2013.01)

(58) Field of Classification Search

CPC ... H01C 3/00; H01C 3/36; H01C 3/34; H01C 3/44; H01P 1/165; H01P 1/182; H01P 1/19; H01P 1/195

USPC ..... 342/372

See application file for complete search history.

(56) References Cited

U.S. PATENT DOCUMENTS 3,080,536 A 3/1963 Dewhirst
3,205,501 A 9/1965 Kuhn (Continued)

FOREIGN PATENT DOCUMENTS

WO WO 9912229 A1 * 3/1999 ..... H01P 1/195

OTHER PUBLICATIONS

European Patent Office, "European Search Report for EP Application No. 16171450.6-1811", "from Foreign counterpart of U.S. Appl. No. 14/733,350", Oct. 12, 2016, pp. 1-9, Published in: EP.

(Continued)

*Primary Examiner* — Harry Liu
(74) *Attorney, Agent, or Firm* — Fogg & Powers LLC

(57) ABSTRACT

A ferrite controller includes a single array of two or more ferrite control elements. The ferrite control elements each include a radio frequency (RF) path assembly that includes a RF path ferrite element and a RF path dielectric element. The ferrite control elements also include a magnetizing ferrite assembly that includes a magnetizing ferrite element; one or more structural dielectric elements; and a flexible insulated waveguide wall. The magnetizing ferrite element is attached to the one or more structural dielectric elements, wherein the flexible insulated waveguide wall surrounds the magnetizing ferrite element and the structural dielectric elements, wherein the RF path ferrite element and the magnetizing ferrite element are attached to form a ferrite toroid. The ferrite control elements also include two tapered impedance matching transformers attached to the RF path assembly and the magnetizing ferrite assembly.

20 Claims, 8 Drawing Sheets

(51) Int. Cl.

| | |
|---|---|
| ***H01Q 3/44*** | (2006.01) |
| ***H01Q 3/34*** | (2006.01) |
| *H01P 5/12* | (2006.01) |
| *H01Q 15/24* | (2006.01) |

(56) References Cited

U.S. PATENT DOCUMENTS

| | | | | | |
|---|---|---|---|---|---|
| 3,354,461 | A | * | 11/1967 | Kelleher | H01Q 3/46 333/1.1 |
| 4,405,927 | A | | 9/1983 | Loomis, III | |
| 4,532,704 | A | * | 8/1985 | Green | H01P 1/195 29/600 |
| 4,818,963 | A | | 4/1989 | Green | |
| 5,729,239 | A | | 3/1998 | Rao | |

OTHER PUBLICATIONS

Rao et al., "Voltage-Controlled Ferroelectric Lens Phased Arrays", "IEEE Transactions on Antennas and Propagation, vol. 47, No. 3, Mar. 1999", pp. 458-468.

Rao et al., "Electronically-Scnaned Lens Antenna", Apr. 20, 2000, pp. 1-15, Publisher: Radar Division Naval Research Laboratory.

Rao et al., "Voltage-Controlled Ferroelectric Lens Phased Arrays", Sep. 23, 1998, pp. 150, Publisher: Naval Research Laboratory.

Wang et al., "An Electrically Scanned Lens Antenna for 2-D Scanning", "Wireless Engineering and Technology", Apr. 2012, pp. 83-85, Publisher: Scientific Research.

* cited by examiner

TWO-DIMENSIONAL ELECTRONICALLY STEERABLE ANTENNA

BACKGROUND

Traditionally, antenna beam-steering has been accomplished using mechanical positioners, multiple beam antennas, and active phased-arrays. Mechanical positioners have been used to direct a single antenna in the desired direction. The mechanical positioner is essentially a robot that moves the antenna in the azimuth (left, right) and elevation (up, down) directions to achieve the desired antenna position. Mechanical positioners are not preferred due to maintenance requirements, speed limitations, and the reliability of the rotary joints.

Multiple-beam antennas use multiple separate antennas pointed in different directions and switch between the separate antennas. Since the use of a large number of individual antennas is not practical, lower gain antennas are traditionally used to cover a wider area. The gain for multiple-beam antennas is further reduced at beam cross-over points. For some applications, the reduction of gain for multiple-beam antennas excludes them as a viable option.

Phased-arrays include a large number of antenna elements (e.g., transmit/receive (T/R) modules) arranged in a plane. For millimeter-wave frequencies (above 30 GHz), phased-arrays are expensive because hundreds or thousands of antenna elements are required and the spacing becomes a difficult and expensive constraint to meet because the wavelengths are small.

For the reasons stated above and for other reasons stated below which will become apparent to those skilled in the art upon reading and understanding the specification, there is a need in the art for improved systems and methods for two-dimensional antenna beam-steering at millimeter-wave frequencies.

SUMMARY

The Embodiments of the present disclosure provide systems for a two-dimensional electronically steerable antenna and will be understood by reading a studying the following specification.

In one embodiment, a ferrite controller comprises: a single array of two or more ferrite control elements, wherein the ferrite control elements each include: a radio frequency (RF) path assembly including a RF path ferrite element and a RF path dielectric element. The ferrite control elements also include a magnetizing ferrite assembly including: a magnetizing ferrite element; one or more structural dielectric elements; and a flexible insulated waveguide wall; wherein the magnetizing ferrite element is attached to the one or more structural dielectric elements, wherein the flexible insulated waveguide wall surrounds the magnetizing ferrite element and the structural dielectric elements, wherein the RF path ferrite element and the magnetizing ferrite element are attached to form a ferrite toroid. The ferrite control elements also include two tapered impedance matching transformers attached to the RF path assembly and the magnetizing ferrite assembly.

DRAWINGS

Understanding that the drawings depict only exemplary embodiments and are not therefore to be considered limiting in scope, the exemplary embodiments will be described with additional specificity and detail through the use of the accompanying drawings, in which.

Figure 1:
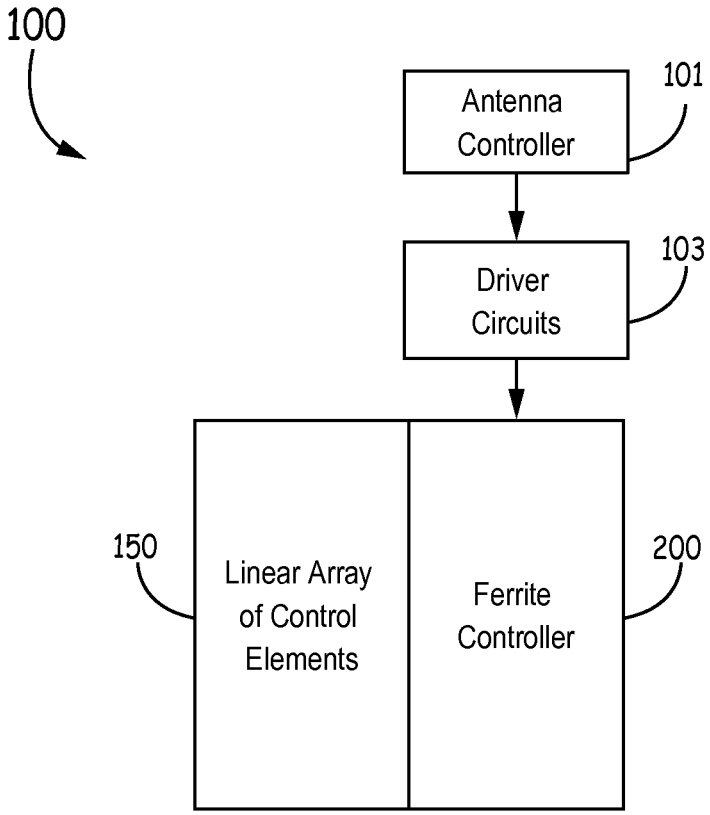
FIG. 1 is a block diagram of an example two-dimensional electronically steerable antenna according to one embodiment of the present disclosure.

In accordance with common practice, the various described features are not drawn to scale but are drawn to emphasize specific features relevant to the exemplary embodiments.

DETAILED DESCRIPTION

In the following detailed description, reference is made to the accompanying drawings that form a part hereof, and in which is shown by way of illustration specific illustrative embodiments. However, it is to be understood that other embodiments may be utilized and that logical, mechanical, and electrical changes may be made. Furthermore, the method presented in the drawing figures and the specification is not to be construed as limiting the order in which the individual steps may be performed. The following detailed description is, therefore, not to be taken in a limiting sense.

Embodiments of the present disclosure provide systems and methods that overcome the above described challenges with traditional antenna beam-steering by separating the elevation and azimuth steering into different stages and utilizing at least one ferrite controller that includes an array of ferrite elements. Each ferrite element may replace a whole row or column of antenna elements in a traditional phased-array. Thus, the number of elements used to provide the desired gain and coverage for millimeter-wave frequencies is manageable. For example, an antenna based on embodiments of the present disclosure only requires $N_{row}+N_{column}$ antenna elements, as opposed to $N_{row}\times N_{column}$ antenna elements for a phased-array, because embodiments can be implemented having only a single column and a single row of antenna elements.

Further, the impact of a one-half wavelength or less spacing requirement is reduced compared to the phased-arrays because each separate stage only needs to accommodate this requirement in a single direction. For example, the antenna elements in the single row of elements need only be spaced one-half wavelength horizontally because there are no elements vertically adjacent to the single row of elements. Likewise, the antenna elements in the single column of elements need only be spaced one-half wavelength vertically because there are no elements horizontally adjacent to the single column of elements.

Embodiments discussed herein thus provide systems for antenna beam-steering having reduced cost and complexity compared to traditional phased-arrays and better performance than mechanical positioners and multiple-beam antennas.

Figure 2:
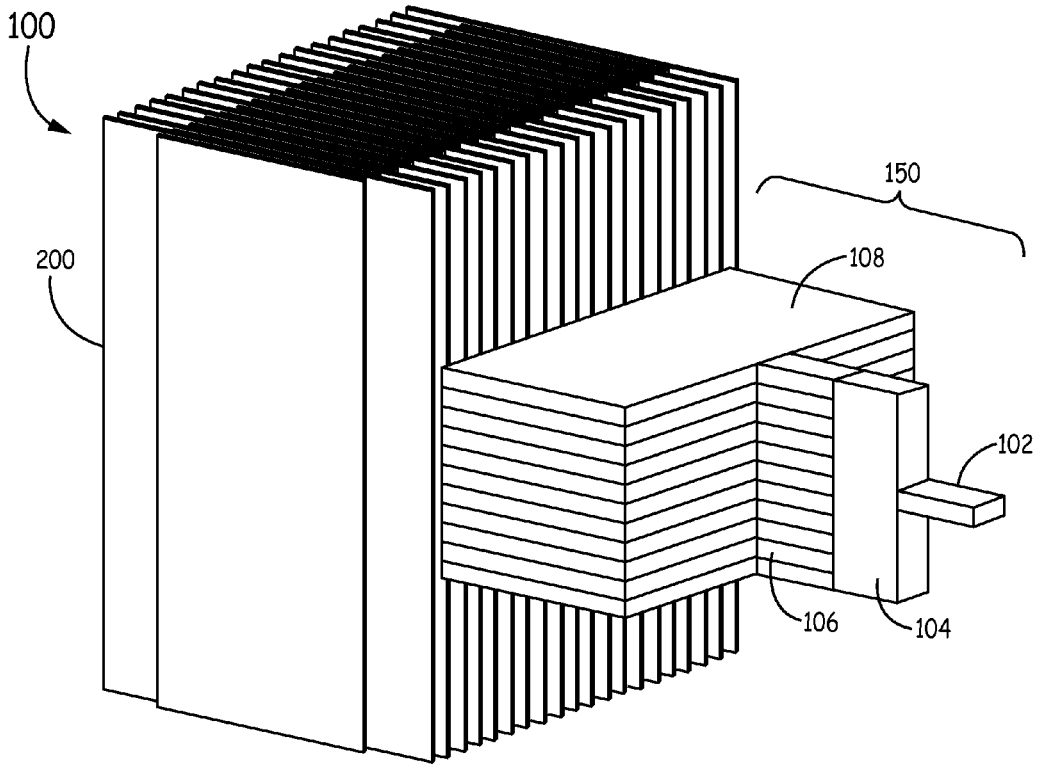
FIG. 2 is a perspective view of an example two-dimensional electronically steerable antenna according to one embodiment of the present disclosure.

FIGS. 1 and 2 illustrate an example two-dimensional electronically steerable antenna 100 according to one embodiment of the present disclosure. Antenna 100 comprises an antenna controller 101, a ferrite controller 200 including a plurality of ferrite elements, one or more driver circuits 103 for each ferrite element, and a linear array of control elements 150. In some embodiments, driver circuits 103 may also be electrically coupled to each control element 150 in order to independently control the phase of RF propagating through each control element 150. For ease of illustration, FIG. 2 does not show the driver circuits 103.

In exemplary embodiments, the control elements 150 include a column of phase shifting elements 106 attached to a column of parallel plates 108. The control elements 150 are attached to a waveguide input 102 and an E-plane power divider 104. In the embodiment shown in FIG. 2, the elevation steering and the azimuth steering of a beam are performed in separate stages. That is, the elevation and azimuth steering are performed by separate distinct groups of control elements, rather than a single plane of control elements. Specifically, the elevation and azimuth steering are performed by a single row of control elements and a single column of control elements. In the embodiment shown in FIG. 2, the linear array of control elements 150 is configured to provide elevation steering and the ferrite controller 200 is configured to provide azimuth steering. In another implementation, the two-dimensional electronically steerable antenna 100 can be rotated 90 degrees such that the linear array of control elements 150 is configured to provide azimuth steering and the ferrite controller 200 is configured to provide elevation steering.

Figure 3:
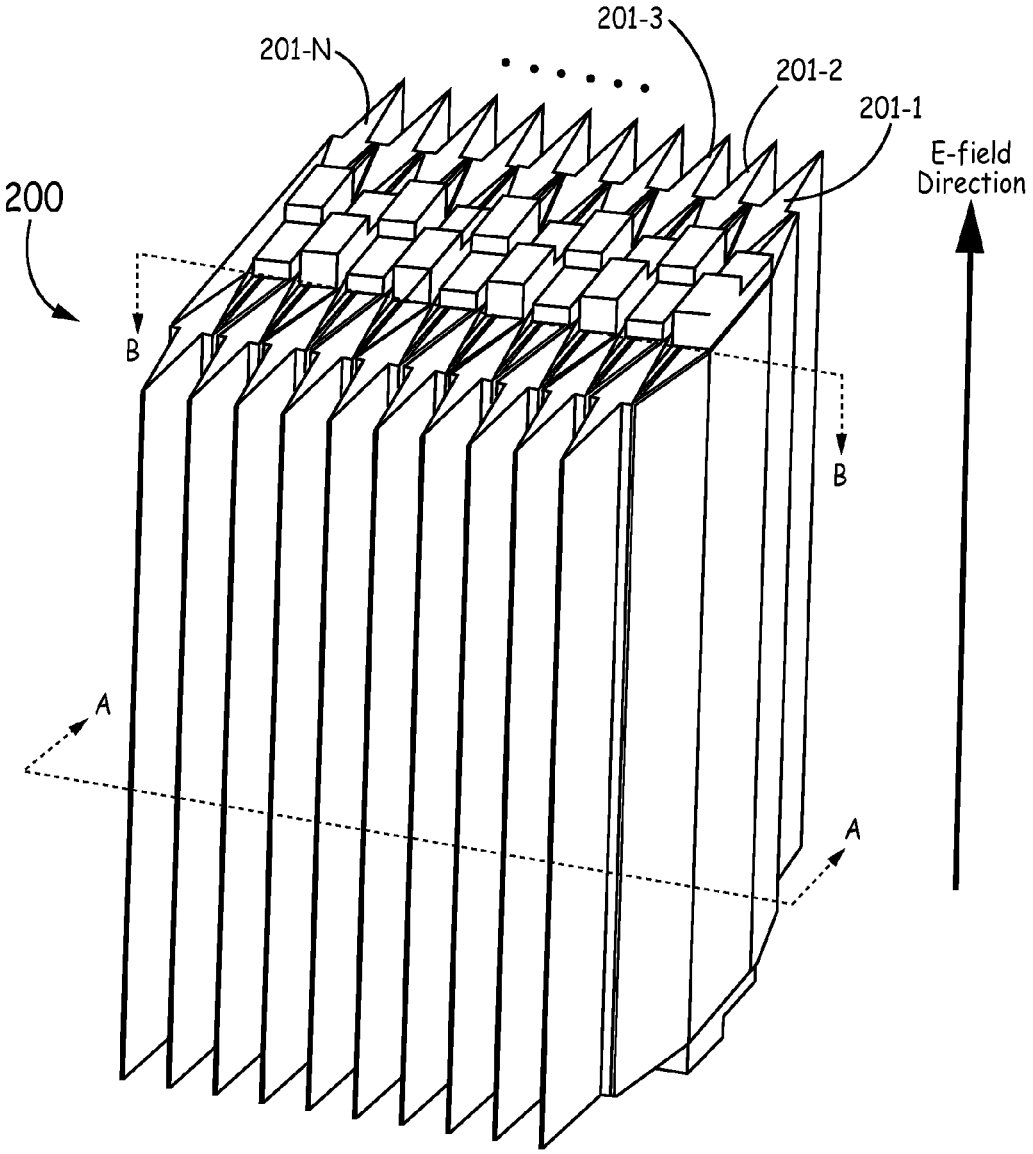
FIG. 3 is a perspective view of an example ferrite controller according to one embodiment of the present disclosure.

FIG. 3 is a perspective view of an example ferrite controller 200 according to one embodiment of the present disclosure. The ferrite controller 200 comprises a plurality of ferrite control elements 201, also referred to herein as ferrite phase shifters. FIGS. 3A-3D will be referenced when describing the features of the ferrite control elements 201 in greater detail. It should be understood that the ferrite controller 200 can include a single array of two or more ferrite control elements 201 depending on the desired gain for the particular application. The number of ferrite control elements 201 determines the size of the ferrite controller 200 and the amount of gain that can be achieved. Thus, the greater the number of ferrite elements 201, the more precise the beam and the greater the gain. In exemplary embodiments, the ferrite control elements 201 have a height of at least five inches so they can be used to replace an entire column or row of antenna elements. For exemplary high-frequency applications (e.g., above 30 GHz), typically a height of five to fifteen inches would be used to produce the desired gain and precision. For proper operation of ferrite controller 200, the E-field of the incident RF is oriented as shown in FIG. 3.

Figure 3A:
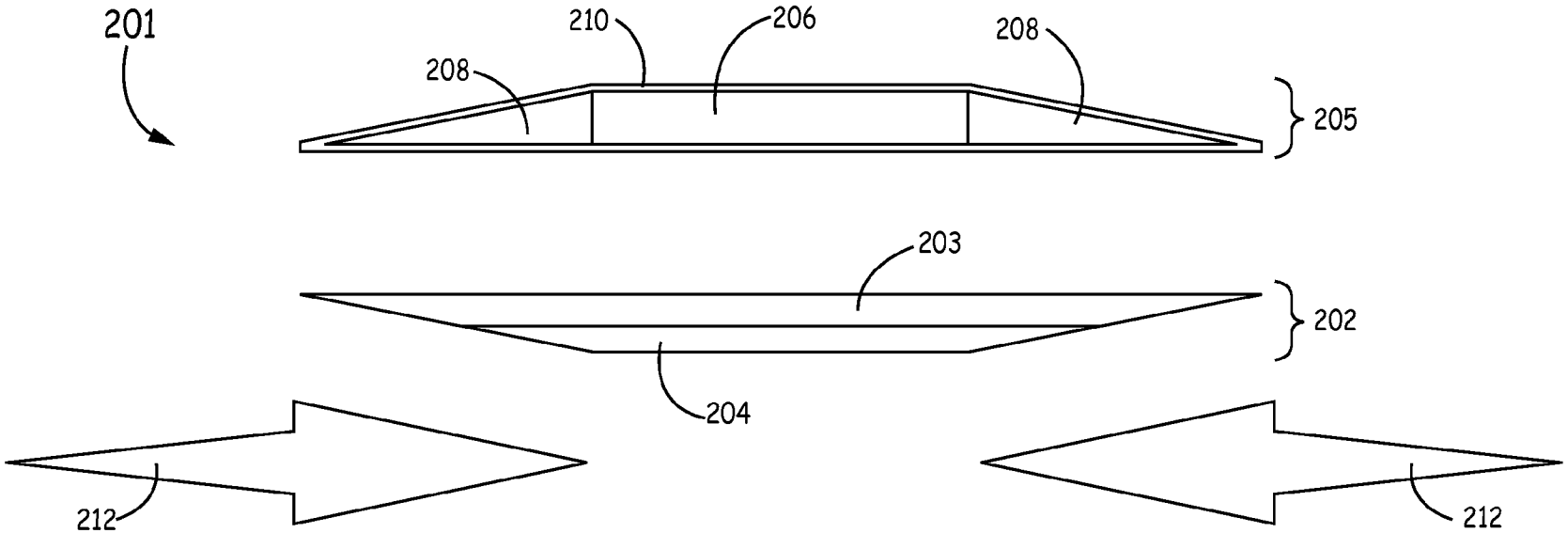
FIG. 3A is an exploded horizontal cross-section of a ferrite control element of an example ferrite controller according to one embodiment of the present disclosure.

FIG. 3A is an exploded horizontal cross-section view of a ferrite control element 201 of an example ferrite controller 200 taken along the line A-A. Each ferrite control element 201 includes a radio frequency (RF) path assembly 202, a magnetizing ferrite assembly 205, and impedance matching transformers 212.

The RF path assembly 202 includes a RF path ferrite element 203 and a RF path dielectric element 204. The RF path ferrite element 203 and the RF path dielectric element 204 are formed as slabs having a substantially rectangular cross-section. In exemplary embodiments, the RF path ferrite element 203 also has a central portion that extends beyond the RF path dielectric element 204. The RF path ferrite element 203 and the RF path dielectric element 204 are each precisely manufactured to have a desired thickness because the thickness of the RF path ferrite element 203 and the RF path dielectric element 204 corresponds to a desired phase shift at the desired RF frequency. In exemplary embodiments, the RF path dielectric element 204 comprises a microwave dielectric or another dielectric material used for antenna applications known to those having skill in the art. The RF path ferrite element 203 and the RF path dielectric element 204 are attached together. In exemplary embodiments, the RF path ferrite element 203 and the RF path dielectric element 204 are bonded using a heat press technique or other methods known to one having skill in the art. After attaching the RF path ferrite element 203 and the RF path dielectric element 204, the RF path assembly 202 is machined to interface with the impedance matching transformers 212.

The magnetizing ferrite assembly 205 includes a magnetizing ferrite element 206, structural dielectric elements 208, and a flexible insulated waveguide wall 210. The magnetizing ferrite element 206 is formed as a slab having a thickness that is at least as thick as the RF path ferrite element 203. This thickness specification prevents flux limitations in the RF path during operation of the ferrite controller 200. The magnetizing ferrite element 206 is isolated from the RF path by the flexible insulated waveguide wall 210. The magnetizing ferrite element 206 is used to control the magnetization state of the ferrite control element 201 and thus the phase of the RF propagating through the RF path assembly 202.

Figure 3B:
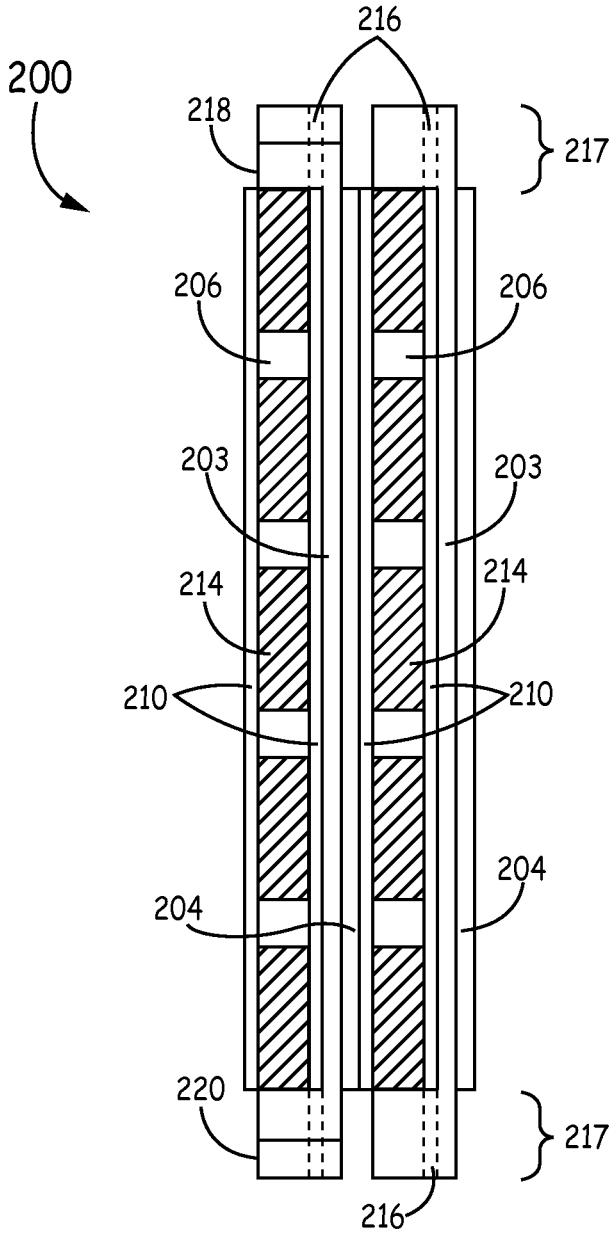
FIG. 3B is a vertical cross-section of two ferrite control elements of an example ferrite controller according to one embodiment of the present disclosure.
Figure 3C:
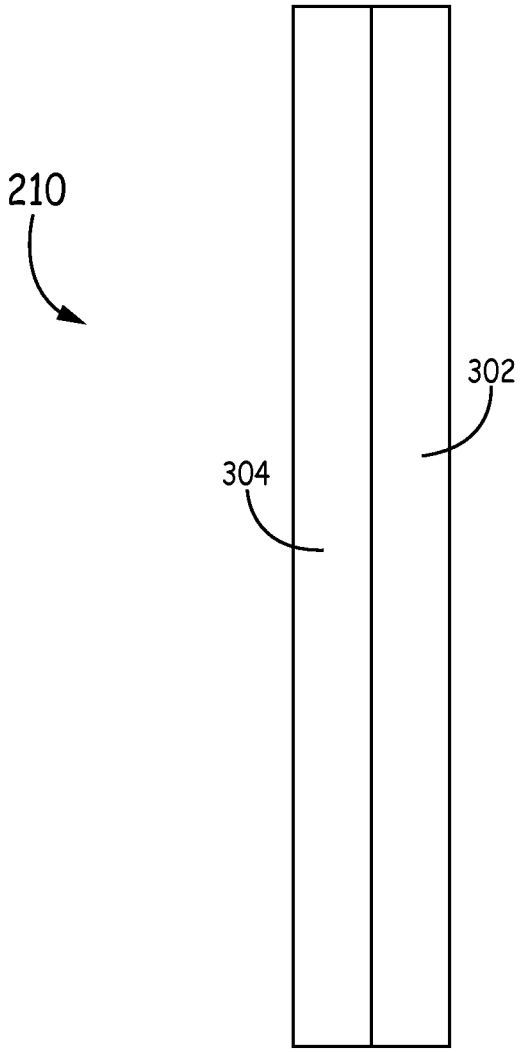
FIG. 3C is a cross-section of an insulated waveguide wall according to one embodiment of the present disclosure.

FIG. 3B is a vertical cross-section view of two adjacent ferrite control elements 201 of an example ferrite controller 200 taken along the line B-B. In exemplary embodiments, the magnetizing ferrite element 206 is etched and plated with a conductive material to form a conductor 214 that continuously wraps around the magnetizing ferrite element 206 in a spiral pattern. The number of turns of the conductor 214 and width of the conductor 214 is selected to be an amount that will evenly distribute an applied current along the height of the magnetizing ferrite element 206. FIG. 3B shows a particular configuration of the conductor 214 according to one embodiment of the present disclosure. The spaces in between the conductor 214 windings are exposed sections of the magnetizing ferrite element 206. It should be understood that the conductor 214 may have any configuration that would evenly distribute an applied current along the height of the magnetizing ferrite element 206.

The structural dielectric elements 208 are attached to the magnetizing ferrite element 206 as shown in FIG. 3A. The structural dielectric elements 208 are chosen to be thermally matched to the magnetizing ferrite element 206. In exemplary embodiments, the structural dielectric elements 208 are substantially wedge-shaped to aid in impedance transformation. In exemplary embodiments, the magnetizing ferrite element 206 and the structural dielectric elements 208 may be bonded together using a heat press technique or other methods known to those having skill in the art.

The flexible insulated waveguide wall 210 is wrapped around the magnetizing ferrite element 206 and the structural dielectric elements 208. The flexible insulated waveguide wall 210 directs the incident RF energy through the RF path assembly 202. The flexible insulated waveguide wall 210 comprises a multi-layer film. For example, in an embodiment shown in FIG. 3C, flexible insulated waveguide wall 210 comprises a conductive layer 302 attached to an insulating layer 304. The conductive layer 302 comprises a copper sheet or another suitable conductive metal. For low-loss implementations, a highly conductive metal, such as gold, silver, or aluminum, would be preferable. The insulating layer 304 comprises a polyimide film such as Kapton or another suitable insulting material known to those having skill in the art. In some embodiments, the insulating layer 304 is also adhesive. In other embodiments, an additional adhesive layer comprising a suitable adhesive material is attached to the insulating layer 304. The insulating layer 304 separates the conductive layer 302, which serves as the waveguide wall, from the conductor 214 wrapped around the magnetizing ferrite element 206. The flexible insulated waveguide wall 210 is selected so there are no horizontal breaks as it is wrapped around the magnetizing ferrite element 206 and the structural dielectric elements 208 because this can cause degraded performance. For example, if the flexible insulated waveguide wall 210 were on a roll, then a horizontal break would not occur if the roll was as wide as the ferrite controller 200 is tall.

The magnetizing ferrite assembly 205 is attached to the RF path assembly 202. In exemplary embodiments, the magnetizing ferrite assembly 205 and the RF path assembly 202 are bonded together using a heat press technique or other methods known to those having skill in the art. Specifically, the RF path ferrite element 203 can be bonded to the flexible insulated waveguide wall 210 and the magnetizing ferrite element 206.

As shown in FIG. 3 and FIG. 3B, end segments 217 of the magnetizing ferrite element 206 and the RF path ferrite element 203 extend beyond the flexible insulated waveguide wall 210. It should be understood that these end segments are omitted from FIG. 2 for ease of illustration. These end segments 217 of the magnetizing ferrite element 206 and the RF path ferrite element 203 extend outwardly from each end of the flexible insulated waveguide wall 210. These end segments of the magnetizing ferrite element 206 and the RF path ferrite element 203 are connected with ferrite 216 and attached to form a ferrite toroid. The dashed lines in FIG. 3B represent where the ferrite 216 is placed between the magnetizing ferrite element 206 and the RF path ferrite element 203.

The end segments 217 also provide access to the conductor 214 for the driver circuit 103 for that ferrite control element 201. The surfaces 218, 220 of the end segments 217 unique to the magnetizing ferrite element 206 that extend outwardly from each end of the flexible insulated waveguide wall 210 are used as contact points for the driver circuit 103 for that ferrite control element 201. In such embodiments, the surfaces 218, 220 are etched and plated with the conductor 214, and the at least one driver circuit 103 is electrically coupled to the conductor 214. The height of the end segments 217 of the magnetizing ferrite element 206 and the RF path ferrite element 203 that extend beyond the flexible insulated waveguide wall 210 can also be staggered for the respective ferrite control elements 201. For example, as shown in FIGS. 3 and 3B, half of each end segment 217 of the magnetizing ferrite element 206 and the RF path ferrite element 203 of a respective ferrite control element 201 extend farther beyond the flexible insulated waveguide wall 210 than the other half of each end segment 217 of the magnetizing ferrite element 206 and the RF path ferrite element 203. This pattern can be alternated between adjacent ferrite control elements 201 to so the staggering allows easier access to the conductors 214.

In exemplary embodiments, the impedance matching transformers 212 are tapered to accommodate a broad range of frequencies and wide elevation angles of RF propagation from the elevation control elements 150. Further, the impedance matching transformers 212 have a low dielectric constant so they are not as sensitive to glue line variations. In prior systems including twin-slab ferrite phase shifters, quarter-wave transformers are used. However, quarter-wave transformers do not perform as well as the tapered impedance matching transformers at wide angles. In exemplary embodiments, the impedance matching transformers 212 are composed of multiple separate pieces for ease of manufacturability. In other embodiments, the impedance matching transformers 212 are a single piece. The impedance matching transformers 212 are attached to the RF path assembly 202 and magnetizing ferrite assembly 205 after those components of the ferrite controller 200 have been attached together.

Figure 3D:
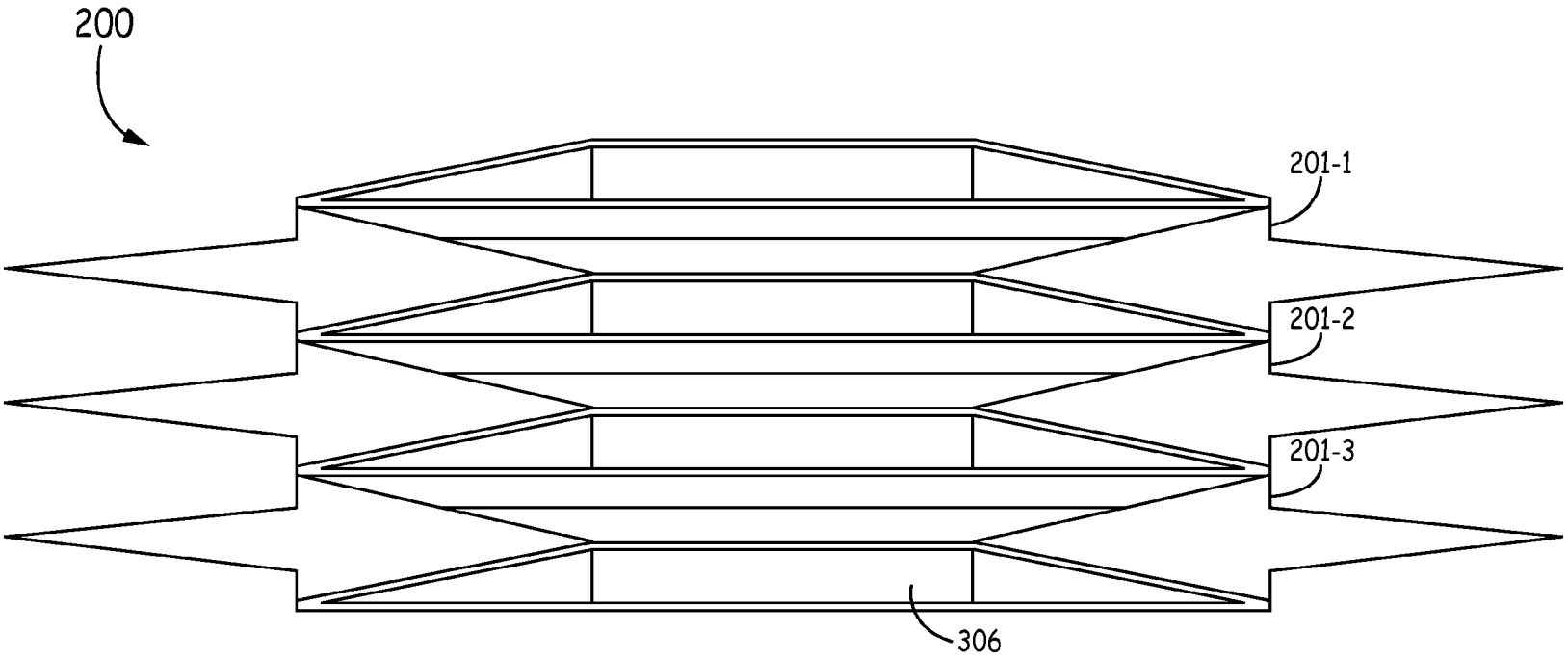
FIG. 3D is a horizontal cross-section of an example ferrite controller according to one embodiment of the present disclosure.

FIG. 3D is an example assembled ferrite controller 200 with three ferrite control elements 201. As discussed above, it should be understood that ferrite controller 200 can include two or more ferrite control elements depending on the desired precision and gain of the particular application. The ferrite control elements 201 contain the same components as the ferrite control elements 201 described above. To connect the assembled ferrite control elements 201 to one another, the magnetizing ferrite assembly of an adjacent ferrite controller is attached to the RF path assembly and the impedance matching transformers. For example, in FIG. 3D, the magnetizing ferrite assembly of ferrite control element 201-2 is attached to the RF path assembly and impedance matching transformers of ferrite control element 201-1. To complete the ferrite controller 200, an additional magnetizing ferrite assembly 306 is attached to the last ferrite control element 201-3 for structural purposes. Specifically, the additional magnetizing ferrite assembly 306 provides a waveguide wall for the RF that propagates through the RF path assembly of ferrite control element 201-3.

The components of adjacent ferrite control elements are spaced a distance apart that is less than or equal to one-half wavelength of the shortest wavelength of a wave to pass through the ferrite controller 200. For example, the tips of the impedance matching transformers of ferrite control element 201-1 are spaced a distance apart from the tips of the impedance matching transformers of ferrite control element 201-2 that is less than or equal to one-half wavelength of the shortest wavelength of a wave to pass through the ferrite controller 200. For example, for a one centimeter wavelength (30 GHz), the spacing would be 0.5 centimeters or less. The other features of adjacent ferrite control elements are also spaced the same distance apart. This spacing prevents undesirable grating lobes. For some applications, a greater than one-half wavelength spacing can be used if grating lobes are small enough or tolerable.

As discussed above, the driver circuit 103 for each ferrite control element 201 is electrically coupled to the conductor 214 that is wrapped around the magnetizing ferrite element 206 to control the phase of each ferrite control element 201. The antenna controller 101 calculates the delta phase between the ferrite toroids that will produce the desired azimuth steering. The antenna controller 101 provides a digital command to the driver circuits 103, which is converted into a voltage pulse by the driver circuits 103. The driver circuits 103 applies an initial saturating voltage pulse to each magnetizing ferrite element 206 in a single direction before applying a controlled non-saturating pulse in the opposite direction to set the magnetization or phase state of the ferrite toroid. In exemplary embodiments, the saturating voltage pulse can be applied in either a clockwise or counter-clockwise direction. The non-saturating pulse finely controls the magnetization state of each ferrite control element 201 and implements the delta phases that were calculated.

This technique utilizes the unique property of ferrite toroids that they will hold a magnetization indefinitely, so constantly supplied voltage is not necessary to magnetize the ferrite phase shifters, only a voltage pulse. This significantly reduces the power necessary to control the phase of the ferrite controller 200. In exemplary embodiments, the ferrite toroids can be magnetized using voltages of less than 200 V.

Figure 4:
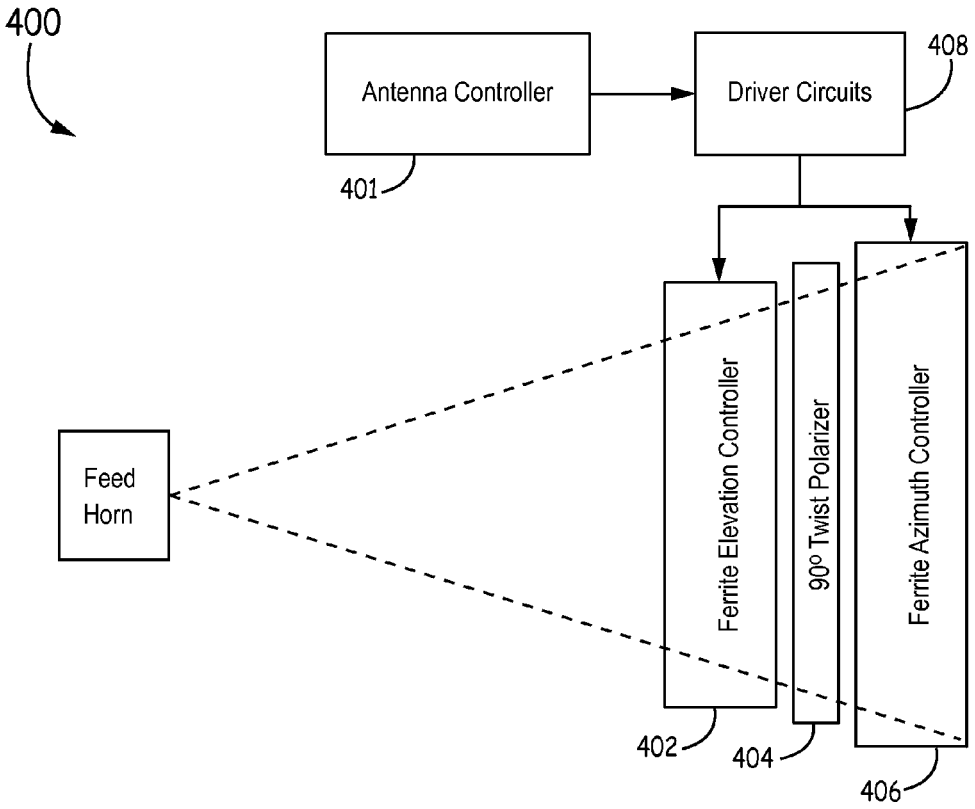
FIG. 4 is a block diagram of an example two-dimensional electronically steerable antenna according to one embodiment of the present disclosure.

FIG. 4 is a block diagram of an example two-dimensional electronically steerable antenna 400 according to one embodiment of the present disclosure. Antenna 400 includes a ferrite elevation controller 402, a 90 degree twist polarizer 404, a ferrite azimuth controller 406, and at least one driver circuit 408 per control element in each ferrite controller 402, 406. Ferrite elevation controller 402 and ferrite azimuth controller 406 include the same features as those discussed above with respect to ferrite controller 200. Thus, only the differences in operation will be discussed.

The ferrite elevation controller 402 is rotated 90 degrees with respect to the ferrite azimuth controller 406. The ferrite elevation controller 402 is configured to control the elevation angle of a RF wave and the ferrite azimuth controller 406 is configured to control the azimuth angle of the RF wave. The polarizer 404 is coupled between the ferrite elevation controller 402 and the ferrite azimuth controller 406 in order to align the E-field of the RF wave prior to propagation through the ferrite azimuth controller 406. In exemplary embodiments, azimuth steering can be performed in the first stage and elevation steering can be performed in the second stage. The operation of the driver circuits 408 is similar to the operation of the driver circuits 103, discussed above with reference to FIGS. 1-3D. However, the antenna controller 401 calculates phases for each ferrite control element 201 in both ferrite controllers 402, 406, and sends digital commands to the driver circuits 408. The driver circuits 408 initially magnetize each ferrite control element 201 in both the ferrite elevation controller 402 and the ferrite azimuth controller 406 with saturating voltage pulses followed by precisely-controlled non-saturating pulses in the opposite direction.

The controllers 101, 401, and the driver circuits 103, 408, include or function with software programs, firmware or other computer readable instructions for carrying out various methods, process tasks, calculations, and control functions, used in controlling the above described two-dimensional antennas 100, 400.

Example 1 includes a ferrite controller, comprising: a single array of two or more ferrite control elements, wherein the ferrite control elements each include: a radio frequency (RF) path assembly including a RF path ferrite element and a RF path dielectric element; a magnetizing ferrite assembly including: a magnetizing ferrite element; one or more structural dielectric elements; and a flexible insulated waveguide wall; wherein the magnetizing ferrite element is attached to the one or more structural dielectric elements, wherein the flexible insulated waveguide wall surrounds the magnetizing ferrite element and the structural dielectric elements, wherein the RF path ferrite element and the magnetizing ferrite element are attached to form a ferrite toroid; and two tapered impedance matching transformers attached to the RF path assembly and the magnetizing ferrite assembly.

Example 2 includes the ferrite controller of Example 1, wherein the flexible insulated waveguide wall comprises a multi-layer film including a conducting layer and an insulating layer.

Example 3 includes the ferrite controller of Example 2, wherein the insulating layer is positioned between the conducting layer and the magnetizing ferrite assembly.

Example 4 includes the ferrite controller of any of Examples 1-3, wherein the RF path assemblies, magnetizing ferrite assemblies, and tapered impedance matching transformers of adjacent ferrite control elements are spaced apart a distance that is less than or equal to one-half wavelength of an RF wave propagating through the ferrite controller.

Example 5 includes the ferrite controller of any of Examples 1-4, further comprising a conductor wrapped around the magnetizing ferrite element.

Example 6 includes the ferrite controller of Example 5, wherein the conductor is wrapped around the magnetizing ferrite element by etching a pattern on the magnetizing ferrite element and plating the etched pattern with a conductive material.

Example 7 includes the ferrite controller of Example 6, wherein end segments of the magnetizing ferrite element extend beyond the flexible insulated waveguide wall; wherein end segments of the RF path ferrite element extend beyond the flexible insulated waveguide wall; and wherein the end segments of the magnetizing ferrite element and the end segments of the RF path ferrite element are attached together using ferrite to form the ferrite toroid.

Example 8 includes the ferrite controller of Example 7, wherein a surface of each of the end segments of the magnetizing ferrite element is etched and plated with the conductive material.

Example 9 includes the ferrite controller of Example 8, further comprising at least one driver circuit per ferrite control element configured to control the phase of each of the two or more ferrite control elements.

Example 10 includes the ferrite controller of Example 9, wherein the at least one driver circuit is electrically coupled to the conductive material on the surface of each of the end segments of the magnetizing ferrite element.

Example 11 includes the ferrite controller of Example 10, wherein the height of the end segments of the magnetizing ferrite element and the height of the end segments of the RF path ferrite element is staggered for adjacent ferrite control elements.

Example 12 includes the ferrite controller of any of Examples 1-11, wherein each tapered impedance matching transformer comprises multiple pieces.

Example 13 includes the ferrite controller of any of Examples 1-12, wherein the structural dielectric elements are wedge-shaped to aid impedance matching.

Example 14 includes a two-dimensional electronically steerable antenna, comprising: an antenna controller; a linear array of control elements, wherein the control elements includes phase shifting elements attached to parallel plates; and a ferrite controller comprising an array of two or more ferrite phase shifters, wherein the ferrite phase shifters each include: a radio frequency (RF) path assembly, wherein the RF path assembly includes a RF path ferrite element and a RF path dielectric element; a magnetizing ferrite assembly, wherein the magnetizing ferrite assembly includes a magnetizing ferrite element, structural dielectric elements, and a flexible insulated waveguide wall, wherein the magnetizing ferrite element is attached to the structural dielectric elements and the flexible insulated waveguide wall surrounds the magnetizing ferrite element and the structural dielectric elements, wherein the RF path ferrite element and the magnetizing ferrite element are attached to form a ferrite toroid; tapered impedance matching transformers; at least one driver circuit per ferrite phase shifter configured to control the phase of each of the ferrite phase shifters.

Example 15 includes the antenna of Example 14, wherein the linear array of control elements is configured to control an elevation angle of a RF wave, wherein the ferrite controller is configured to control an azimuth angle of the RF wave.

Example 16 includes the antenna of any of Examples 14-15, further comprising a conductor wrapped around the magnetizing ferrite element.

Example 17 includes a two-dimensional electronically steerable antenna, comprising: first and second ferrite controllers each comprising an array of two or more ferrite control elements, wherein the ferrite control elements each include: a radio frequency (RF) path assembly including a RF path ferrite element and a RF path dielectric element; a magnetizing ferrite assembly including a magnetizing ferrite element, structural dielectric elements, and a flexible insulated waveguide wall, wherein the magnetizing ferrite element is attached to the structural dielectric elements and the flexible insulated waveguide wall surrounds the magnetizing ferrite element and the structural dielectric elements, wherein the RF path ferrite element and the magnetizing ferrite element are attached to form a ferrite toroid; and tapered impedance matching transformers; at least one driver circuit per ferrite control element configured to control the phase of the ferrite control elements of the first and second ferrite controllers; and a 90 degree twist polarizer coupled between the first and second ferrite controllers; wherein the second ferrite controller is rotated 90 degrees with respect to the first ferrite controller.

Example 18 includes the antenna of Example 17, wherein the first ferrite controller is configured to control an elevation angle of a RF wave, wherein the second ferrite controller is configured to control an azimuth angle of the RF wave.

Example 19 includes the antenna of any of Examples 17-18, further comprising a conductor wrapped around the magnetizing ferrite element.

Example 20 includes the antenna of Example 19, wherein the at least one driver circuit is electrically coupled to the conductor wrapped around the magnetizing ferrite element.

In various alternative embodiments, system elements, method steps, or examples described throughout this disclosure (such as antenna controllers 101, 401, driver circuits 103 and 408, and ferrite controllers 200, 402 and 406, or sub-parts thereof, for example) may be implemented on one or more computer systems, field programmable gate array (FPGA), or similar devices comprising a processor and memory hardware executing code to realize those elements, processes, or examples, said code stored on a non-transient data storage device. Therefore other embodiments of the present disclosure may include such a processor and memory hardware as well as elements comprising program instructions resident on computer readable media which when implemented by such computer systems, enable them to implement the embodiments described herein. As used herein, the term "computer readable media" refers to tangible memory storage devices having non-transient physical forms. Such non-transient physical forms may include computer memory devices, such as but not limited to punch cards, magnetic disk or tape, any optical data storage system, flash read only memory (ROM), non-volatile ROM, programmable ROM (PROM), erasable-programmable ROM (E-PROM), random access memory (RAM), or any other form of permanent, semi-permanent, or temporary memory storage system or device having a physical, tangible form. Program instructions include, but are not limited to computer-executable instructions executed by computer system processors and hardware description languages such as Very High Speed Integrated Circuit (VHSIC) Hardware Description Language (VHDL).

Although specific embodiments have been illustrated and described herein, it will be appreciated by those of ordinary skill in the art that any arrangement, which is calculated to achieve the same purpose, may be substituted for the specific embodiments shown. Therefore, it is manifestly intended that this invention be limited only by the claims and the equivalents thereof.

What is claimed is:

1. A ferrite controller, comprising:

a single array of two or more ferrite control elements, wherein the ferrite control elements each include:

a radio frequency (RF) path assembly including a RF path ferrite element and a RF path dielectric element;

a magnetizing ferrite assembly including:

a magnetizing ferrite element;

one or more structural dielectric elements; and a flexible insulated waveguide wall;

wherein the magnetizing ferrite element is attached to the one or more structural dielectric elements, wherein the flexible insulated waveguide wall surrounds the magnetizing ferrite element and the structural dielectric elements, wherein the RF path ferrite element and the magnetizing ferrite element are attached to form a ferrite toroid; and two tapered impedance matching transformers attached to the RF path assembly and the magnetizing ferrite assembly.

2. The ferrite controller of claim 1, wherein the flexible insulated waveguide wall comprises a multi-layer film including a conducting layer and an insulating layer.

3. The ferrite controller of claim 2, wherein the insulating layer is positioned between the conducting layer and the magnetizing ferrite assembly.

4. The ferrite controller of claim 1, wherein the RF path assemblies, magnetizing ferrite assemblies, and tapered impedance matching transformers of adjacent ferrite control elements are spaced apart a distance that is less than or equal to one-half wavelength of an RF wave propagating through the ferrite controller.

5. The ferrite controller of claim 1, further comprising a conductor wrapped around the magnetizing ferrite element.

6. The ferrite controller of claim 5, wherein the conductor is wrapped around the magnetizing ferrite element by etching a pattern on the magnetizing ferrite element and plating the etched pattern with a conductive material.

7. The ferrite controller of claim 6, wherein end segments of the magnetizing ferrite element extend beyond the flexible insulated waveguide wall;

wherein end segments of the RF path ferrite element extend beyond the flexible insulated waveguide wall; and wherein the end segments of the magnetizing ferrite element and the end segments of the RF path ferrite element are attached together using ferrite to form the ferrite toroid.

8. The ferrite controller of claim 7, wherein a surface of each of the end segments of the magnetizing ferrite element is etched and plated with the conductive material.

9. The ferrite controller of claim 8, further comprising at least one driver circuit per ferrite control element configured to control the phase of each of the two or more ferrite control elements.

10. The ferrite controller of claim 9, wherein the at least one driver circuit is electrically coupled to the conductive material on the surface of each of the end segments of the magnetizing ferrite element.

11. The ferrite controller of claim 10, wherein the height of the end segments of the magnetizing ferrite element and the height of the end segments of the RF path ferrite element is staggered for adjacent ferrite control elements.

12. The ferrite controller of claim 1, wherein each tapered impedance matching transformer comprises multiple pieces.

13. The ferrite controller of claim 1, wherein the structural dielectric elements are wedge-shaped to aid impedance matching.

14. A two-dimensional electronically steerable antenna, comprising:

an antenna controller;

a linear array of control elements, wherein the control elements includes phase shifting elements attached to parallel plates; and a ferrite controller comprising an array of two or more ferrite phase shifters, wherein the ferrite phase shifters each include:

a radio frequency (RF) path assembly, wherein the RF path assembly includes a RF path ferrite element and a RF path dielectric element;

a magnetizing ferrite assembly, wherein the magnetizing ferrite assembly includes a magnetizing ferrite element, structural dielectric elements, and a flexible insulated waveguide wall, wherein the magnetizing ferrite element is attached to the structural dielectric elements and the flexible insulated waveguide wall surrounds the magnetizing ferrite element and the structural dielectric elements, wherein the RF path ferrite element and the magnetizing ferrite element are attached to form a ferrite toroid;

tapered impedance matching transformers;

at least one driver circuit per ferrite phase shifter configured to control the phase of each of the ferrite phase shifters.

15. The antenna of claim 14, wherein the linear array of control elements is configured to control an elevation angle of a RF wave, wherein the ferrite controller is configured to control an azimuth angle of the RF wave.

16. The antenna of claim 14, further comprising a conductor wrapped around the magnetizing ferrite element.

17. A two-dimensional electronically steerable antenna, comprising:

first and second ferrite controllers each comprising an array of two or more ferrite control elements, wherein the ferrite control elements each include:

a radio frequency (RF) path assembly including a RF path ferrite element and a RF path dielectric element;

a magnetizing ferrite assembly including a magnetizing ferrite element, structural dielectric elements, and a flexible insulated waveguide wall, wherein the magnetizing ferrite element is attached to the structural dielectric elements and the flexible insulated waveguide wall surrounds the magnetizing ferrite element and the structural dielectric elements, wherein the RF path ferrite element and the magnetizing ferrite element are attached to form a ferrite toroid; and tapered impedance matching transformers;

at least one driver circuit per ferrite control element configured to control the phase of the ferrite control elements of the first and second ferrite controllers; and a 90 degree twist polarizer coupled between the first and second ferrite controllers;

wherein the second ferrite controller is rotated 90 degrees with respect to the first ferrite controller.

18. The antenna of claim 17, wherein the first ferrite controller is configured to control an elevation angle of a RF wave, wherein the second ferrite controller is configured to control an azimuth angle of the RF wave.

19. The antenna of claim 17, further comprising a conductor wrapped around the magnetizing ferrite element.

20. The antenna of claim 19, wherein the at least one driver circuit is electrically coupled to the conductor wrapped around the magnetizing ferrite element.

* * * * *